US010174992B2

(12) United States Patent
Rotter et al.

(10) Patent No.: US 10,174,992 B2
(45) Date of Patent: Jan. 8, 2019

(54) VARIABLE WIDTH DELI COVER

(71) Applicant: WHIRLPOOL CORPORATION, Benton Harbor, MI (US)

(72) Inventors: Chad J. Rotter, Amana, IA (US); Trevor L. Hawkins, Belle Plaine, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 266 days.

(21) Appl. No.: 15/254,218

(22) Filed: Sep. 1, 2016

(65) Prior Publication Data

US 2018/0058750 A1 Mar. 1, 2018

(51) Int. Cl.
*F25D 25/02* (2006.01)

(52) U.S. Cl.
CPC ..... *F25D 25/02* (2013.01)

(58) Field of Classification Search
CPC ..... F25D 25/02; F25D 25/024; F25D 25/025
See application file for complete search history.

(56) References Cited

U.S. PATENT DOCUMENTS 2,613,818 A * 10/1952 Richard ..... F25D 25/02 211/135
2,815,649 A * 12/1957 Di Angelus ..... F25D 19/00 312/107
3,110,536 A * 11/1963 Costantini ..... A47B 57/404 312/350
3,177,988 A * 4/1965 Costantini ..... F25D 25/02 248/218.4
3,186,364 A * 6/1965 Angelus ..... A47B 57/40 108/146
3,407,016 A * 10/1968 Kronenberger ..... F25D 21/14 312/229
3,421,803 A * 1/1969 Lustig ..... F25D 23/069 312/350
3,682,521 A * 8/1972 Kesling ..... A47B 57/10 297/153
5,403,083 A 4/1995 Dasher et al.
8,733,862 B1 * 5/2014 Armstrong ..... F24C 15/16 126/337 A
8,820,865 B2 9/2014 Simpson et al.
8,944,621 B2 * 2/2015 Driver ..... A47B 57/42 362/249.05
9,022,495 B1 * 5/2015 Conner, Sr. ..... F25D 25/027 312/238
9,581,383 B2 * 2/2017 Brown ..... F25D 27/00
9,989,232 B2 * 6/2018 Burke ..... F21V 23/06
(Continued)

*Primary Examiner* — Hanh V Tran
(74) *Attorney, Agent, or Firm* — Price Heneveld LLP

(57) ABSTRACT

A variable width shelf assembly includes a shelf panel with first and second support brackets. One or more support slots and one or more relief slots are disposed on an upright portion of the support brackets. One or more coupling tabs are disposed adjacent to one of the one or more support slots and one of the one or more relief slots. The coupling tabs are flexible tabs configured to flex outwardly relative to the upright portion of the support brackets for coupling the first and second brackets to a refrigerator compartment. Mounting plates mounted on a refrigerator include mounting features that are received in the support slots of the support brackets. Abutment guides on the mounting plates are used to guide a bending motion of the coupling tabs in assembly.

19 Claims, 12 Drawing Sheets

(56) References Cited

U.S. PATENT DOCUMENTS

| | | | | |
|---|---|---|---|---|
| 2002/0069599 | A1 | 6/2002 | Dhallan | |
| 2004/0149668 | A1* | 8/2004 | Fann | A47B 73/002 211/74 |
| 2004/0263038 | A1* | 12/2004 | Ribolzi | F25D 23/067 312/408 |
| 2006/0213849 | A1* | 9/2006 | Bienick | A47B 96/028 211/90.02 |
| 2009/0308098 | A1* | 12/2009 | An | F25D 25/02 62/449 |
| 2013/0026321 | A1 | 1/2013 | Richardson et al. | |
| 2013/0081421 | A1* | 4/2013 | Kwon | F25D 23/04 62/440 |
| 2013/0088136 | A1* | 4/2013 | Bassi | F25D 25/02 312/408 |
| 2013/0340466 | A1 | 12/2013 | Hines | |
| 2015/0226474 | A1* | 8/2015 | Choi | F25D 25/02 312/404 |
| 2016/0161669 | A1* | 6/2016 | Lee | F25D 25/02 362/621 |
| 2016/0270536 | A1* | 9/2016 | Ferreira | A47B 96/068 |
| 2017/0284732 | A1* | 10/2017 | Cosgrove | G06F 19/00 |
| 2017/0321957 | A1* | 11/2017 | Erol | F25D 23/067 |

* cited by examiner

VARIABLE WIDTH DELI COVER

BACKGROUND

The present device generally relates to a shelf assembly for a refrigerator compartment, and more particularly, to a deli cover that includes adaptable brackets for accommodating various size liners used to define a refrigerator compartment.

When constructing a refrigerator, a liner is used to define a refrigerator compartment. When providing options such as refrigerated drawers or deli-style drawers, a cover is needed that spans the inner sidewalls of the liner for coupling thereto. In manufacturing, the liner width may vary particularly when used in a vacuum insulated refrigerator. Thus, a production deli cover is desired wherein the connecting brackets for the deli cover are able to accommodate various spans of inner sidewalls for various refrigerator liners. Further, in the assembly of a refrigerator compartment, a deli cover having a support bracket configuration that is narrower than the span of the liner is desired, such that the deli cover will not scratch the liner sidewalls when the deli cover is installed during assembly. Thus, the deli cover must have support structures that are narrower than the liner sidewalls and configured to expand to a greater width during installation to sufficiently couple to the liner sidewalls in a support configuration.

SUMMARY

One aspect of the present concept includes a variable width shelf assembly having a shelf panel with first and second support brackets coupled to the shelf panel at opposite sides thereof. Each support bracket includes a body portion having an upright portion and a support portion extending inwardly from the upright portion. One or more support slots and one or more relief slots are disposed on the upright portion of the support brackets. One or more coupling tabs are disposed adjacent to one of the one or more support slots and one of the one or more relief slots. The coupling tabs are flexible tabs configured to flex outwardly relative to the upright portion of the body portion for coupling the first and second brackets to a refrigerator compartment.

Another aspect of the present concept includes an adjustable shelf assembly for a refrigerator. The refrigerator includes a refrigerator compartment having first and second opposed sidewalls with inner and outer surfaces. The refrigerator compartment includes a width defined between the inner surfaces of the first and second sidewalls. The first and second sidewalls include a plurality of slots disposed therethrough. First and second mounting plates are coupled to the outer surfaces of the first and second sidewalls, respectively, and include one or more mounting features received through one or more of the slots disposed through the first and second sidewalls. A shelf assembly includes a shelf panel with first and second support brackets disposed on opposed side edges of the shelf panel. The first and second support brackets each include a body portion having an upright portion with one or more coupling tabs disposed thereon. The coupling tabs are configured to flex outwardly relative to the upright portion for coupling the first and second brackets to the first and second mounting plates, respectively. The body portion further includes one or more support slots, wherein the one or more mounting features of the mounting plates are received in the one or more support slots within the refrigerator compartment in assembly.

Yet, another aspect of the present concept includes a method of installing a shelf assembly in a refrigerator. The method includes: a) providing a refrigerator compartment having a width defined between inner surfaces of opposed first and second sidewalls of the refrigerator compartment; b) mounting first and second mounting plates on each of the sidewalls of the refrigerator compartment, wherein the first and second mounting plates include one or more mounting features extending into the refrigerator compartment through the first and second sidewalls, respectively; c) providing a shelf assembly having first and second support brackets disposed on opposite sides thereof, the first and second support brackets including outer surfaces, one or more flexible coupling tabs and one or more support slots, wherein the outer surfaces of the support brackets define a width of the shelf assembly, wherein the width of the shelf assembly is less than the width of the refrigerator compartment; d) receiving the shelf assembly within the refrigerator compartment above the first and second mounting brackets; e) lowering the shelf assembly such that the one or more mounting features of the first and second mounting plates are received in the one or more support slots of the first and second support brackets, respectively; f) driving the one or more flexible coupling tabs from at-rest positions to outwardly flexed positions using one or more fasteners; and g) expanding the width of the shelf assembly to a second width defined by outer surfaces of the one or more flexible coupling tabs when the one or more flexible coupling tabs are in the outwardly flexed positions.

These and other features, advantages, and objects of the present device will be further understood and appreciated by those skilled in the art upon studying the following specification, claims, and appended drawings.

DETAILED DESCRIPTION OF EMBODIMENTS

Figure 1:
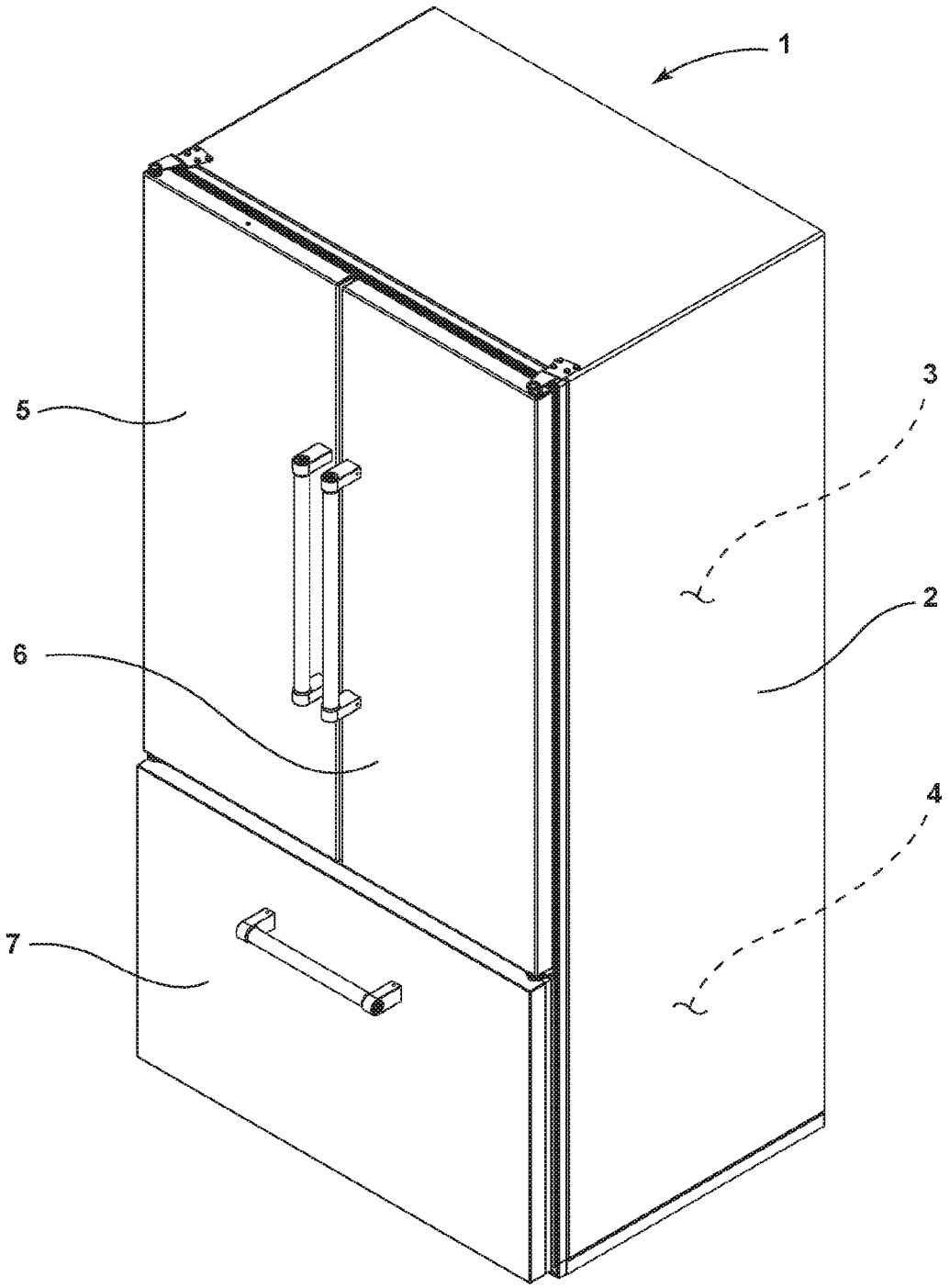
FIG. 1 is a top perspective view of a refrigerator configured for use with the present concept.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a refrigerator 1 includes a vacuum insulated cabinet structure 2 which includes a refrigerator compartment 3 and a freezer compartment 4. Doors 5 and 6 are provided to selectively provide access to the refrigerator compartment 3, while a drawer 7 is used to provide access to the freezer compartment 4.

Figure 2:
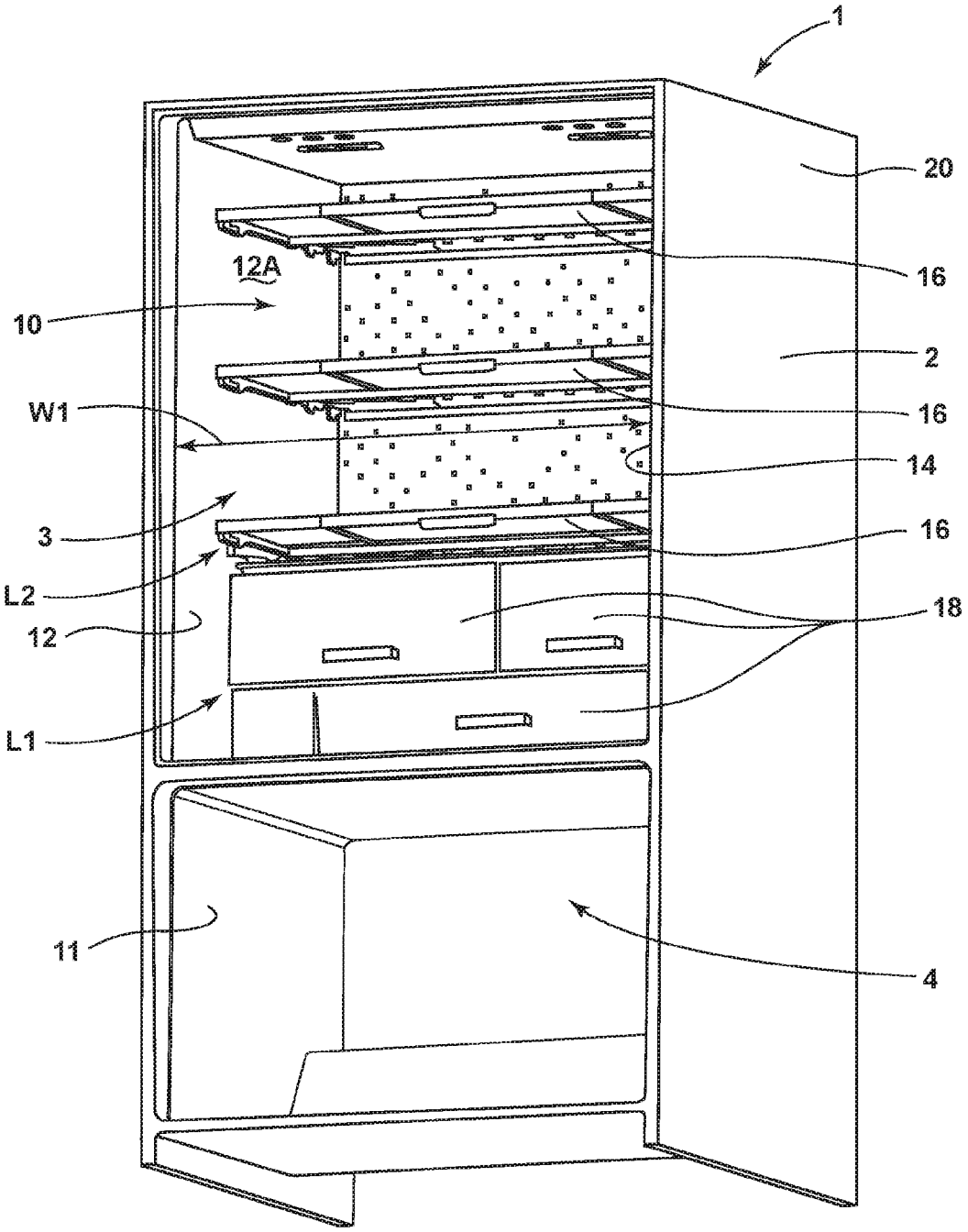
FIG. 2 is a bottom perspective view of the refrigerator of FIG. 1 with the doors and drawer removed to reveal a refrigerator compartment and a freezer compartment.
Figure 4:
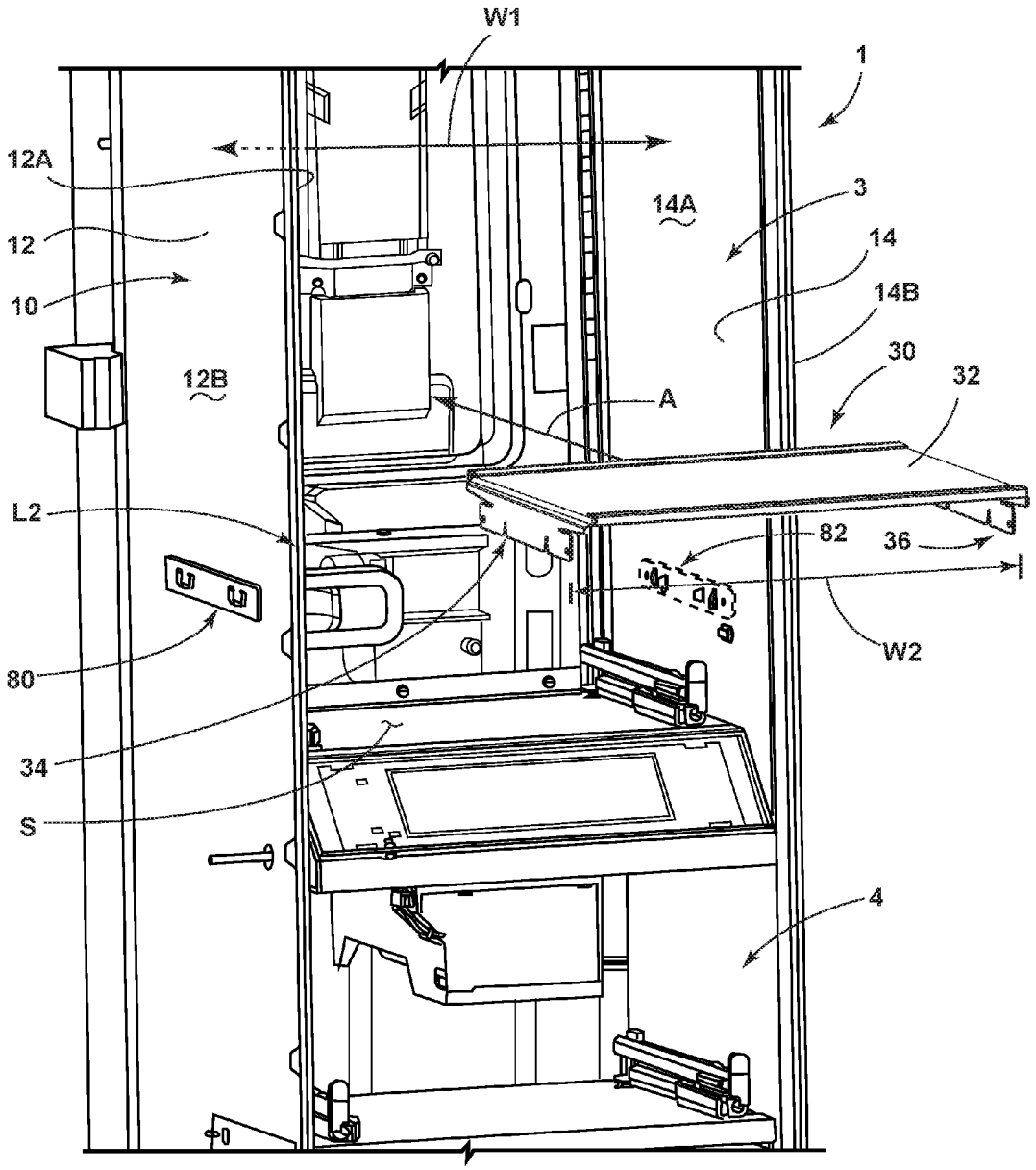
FIG. 4 is a top perspective view of the refrigerator of FIG. 2 having an exterior wrapper removed therefrom and the shelf assembly of FIG. 3A exploded away from the refrigerator compartment.

Referring now to FIG. 2, the refrigerator 1 is shown with the doors 5 and 6, and drawer 7 removed therefrom to reveal the refrigerator compartment 3 and freezer compartment 4. In the embodiment shown in FIG. 2, the refrigerator compartment 3 includes a refrigerator liner 10. The refrigerator liner 10 includes a pair of opposed sidewalls 12, 14 having inner surfaces 12A, 14A (FIG. 4) and outer surfaces 12B, 14B (FIG. 4). The inner surfaces 12A, 14A cooperate to define a width W1 for the refrigerator compartment 3 spanning the distance between the opposed sidewalls 12, 14. In the refrigerator compartment 3, a plurality of shelves 16 are shown which are contemplated to be vertically adjustable structures for customized placement within the refrigerator compartment 3. As further shown in FIG. 2, a number of drawers 18 are shown disposed below the shelves 16 and are contemplated to be refrigerated drawers for fresh food items, and may further include one or more deli-style drawers spanning the width W1 of the refrigerator compartment 3. In locations L1 or L2 within the refrigerator compartment 3, a fixed support structure or shelf assembly may be desired to cover the drawers 18 along an upper portion thereof, such that the fixed support structure will generally cover the width W1 of the refrigerator compartment 3 by spanning from inner surface 12A of sidewall 12 to inner surface 14A (FIG. 4) of sidewall 14 in assembly.

As noted above, the refrigerator 1 of the present concept includes a refrigerator compartment 3 disposed within a vacuum insulated cabinet structure 2. The vacuum insulated cabinet structure 2 is generally created and defined in a space between the refrigerator liner 10 and the freezer liner 11 as spaced-apart from an exterior wrapper 20. The spacing between the exterior wrapper 20 and the refrigerator liner 10 and freezer liner 11 provides an insulating space that can be vacuum sealed using a vacuum sealing technique. This type of sealing and insulating technique may cause for fine variations in the distance between the sidewalls 12 and 14 of the refrigerator liner 10, such that the width W1 of the refrigerator 1 may vary as compared to the width of another refrigerator formed with an identical vacuum insulating and sealing technique. Thus, for ease of assembly, a support structure that spans the width W1 of the refrigerator 1 must be a variable or adjustable support structure that can be easily manufactured for use in a variety of refrigerators having variable widths.

Figure 3A:
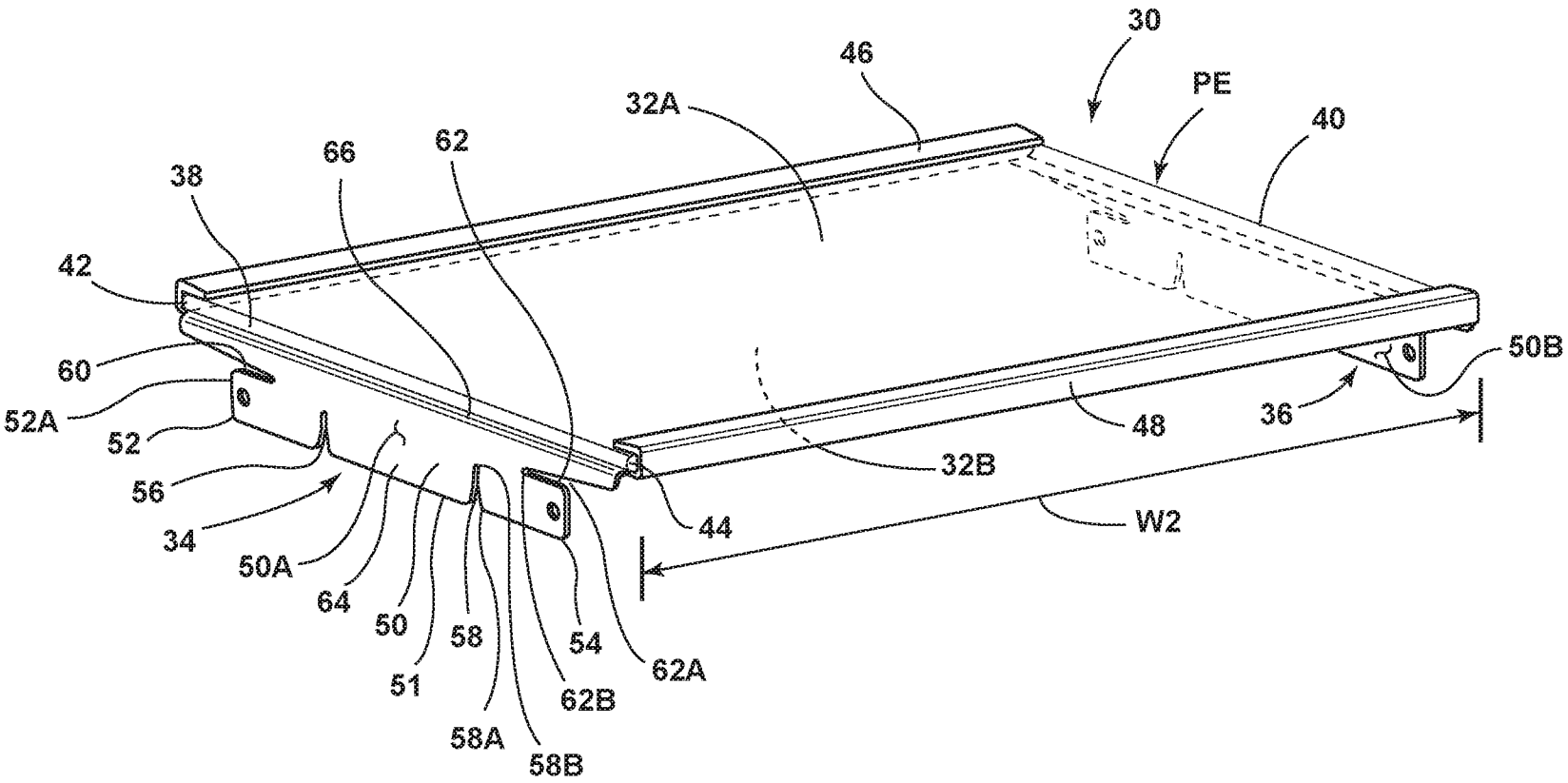
FIG. 3A is a top perspective view of a shelf assembly according to one embodiment of the present concept.

Referring now to FIG. 3A, a shelf assembly 30 is shown, wherein the shelf assembly 30 includes a shelf panel 32 supported on support brackets 34, 36 disposed on opposite sides 38, 40 of the shelf panel 32. The shelf panel 32 includes an upper surface 32A that is spaced-apart from a lower surface 32B. The shelf panel 32 further includes a rear edge 42 and a front edge 44 which cooperate with the opposed side edges 38, 40 to define a peripheral edge PE of the shelf panel 32. In the embodiment shown in FIG. 3A, the rear edge 42 and front edge 44 of the shelf panel 32 have cover members 46, 48 disposed therearound which may help with the containment of spilled substances that may be deposited on the upper surface 32A of the shelf panel 32 during use.

With further reference to FIG. 3A, the support brackets 34, 36 are configured to couple to the sidewalls of a refrigerator, such as sidewalls 12, 14 of the refrigerator liner 10 shown in FIG. 2. The support brackets 34, 36 are similar in configuration and will be described herein using like reference numerals. Further, as one support bracket is described in this disclosure, the features of that support bracket will also describe the identical features of the companion support bracket. In the embodiment shown in FIG. 3A, the support brackets 34, 36 are shown supporting the shelf panel 32 in a mirror configuration relative to one another. Each of the support brackets 34, 36 includes a body portion 50 having first and second flexible coupling tabs 52, 54 disposed adjacent to vertically configured support slots 56, 58, respectively, along with horizontally configured relief slots 60, 62, respectively. The support slots 56, 58 and relief slots 60, 62 define cutout portions of the body portion 50 of the support brackets 34, 36 which define the coupling tabs 52, 54 and allow the coupling tabs 52, 54 to flex or adjust, as further described below. As further shown in FIG. 3A, the support brackets 34, 36 generally include an upright portion 64 and an inwardly curved horizontal support portion 66. As shown in FIG. 3A, the support portion 66 extends inwardly from the upright portion 64 at approximately 90°, and abuts the lower surface 32B of the shelf panel 32 for supporting the same. The upright portion 64 includes the vertical support slots 56, 58, the horizontal relief slots 60, 62, and the coupling tabs 52, 54 for positioning and coupling the support brackets 34, 36 to the inner surfaces of the liner walls, such as inner surfaces 12A, 14A of sidewalls 12, 14 of the refrigerator liner 10 shown in FIGS. 2 and 4.

With further reference to FIG. 3A, the support slots 56, 58 are tapered slots that extend upwardly from a bottom edge 51 of the body portion 50. With specific reference to support slot 58, which has a similar configuration to support slot 56, each support slot 56, 58 includes an open bottom end 58A and a closed top end 58B. Support slot 58 tapers inwardly, such that the support slot 58 narrows from the open bottom end 58A to the closed top end 58B. In this way, a mounting feature can be closely received in the tapper support slot 58, such that there will be little to no play between the support bracket 34 and the mounting feature, as further described below. Similarly, the relief slots 60, 62 are also tapered slots which extend inwardly from opposed end portions 54A, 54B of the body portion 50. With specific reference to relief slot 62, which has a similar configuration to relief slot 60, each relief slot 60, 62 includes an open outer end 62A and a closed inner end 62B. Relief slot 62 tapers inwardly, such that the relief slot 62 narrows from the open outer end 62A to the closed inner end 62B.

Figure 3B:
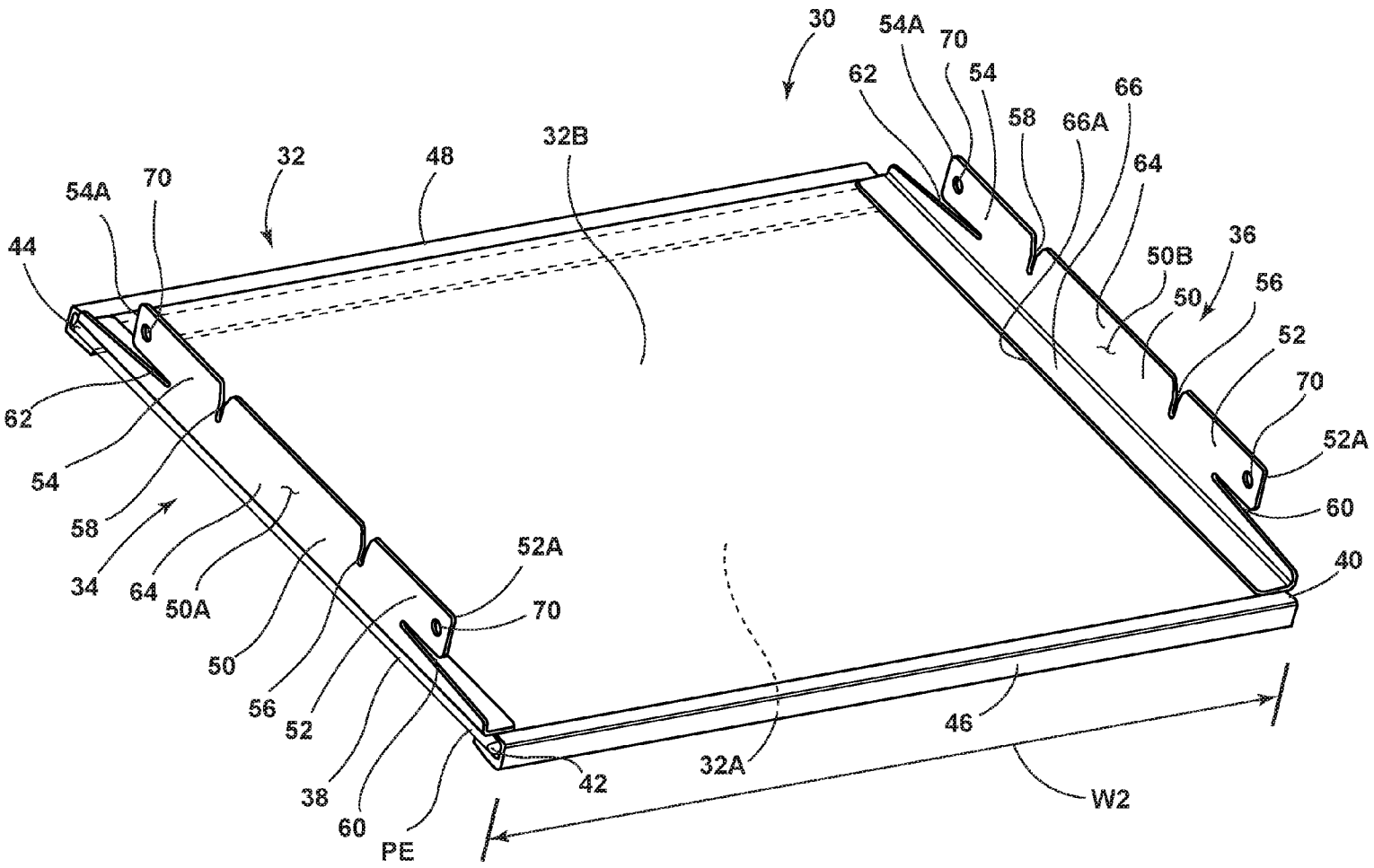
FIG. 3B is a bottom perspective view of a shelf assembly of FIG. 3A.

Referring now to FIG. 3B, the shelf assembly 30 is shown from a bottom perspective view, wherein an upper surface 66A of support portion 66 of support bracket 36 is shown abutting the lower surface 32B of the shelf panel 32. It is contemplated that the shelf panel 32 may be a glass panel, wherein the shelf panel 32 may be coupled to the upper surface 66A of support portion 66 of support bracket 36 using an adhesive. When the shelf panel 32 is made of a plastic or other like material, it is contemplated that the shelf panel 32 may be coupled to the support portion 66 of the support brackets 36, 34 using fasteners or welding. As further shown in FIG. 3B, the coupling tabs 52, 54 of the support brackets 34, 36 include mounting apertures 70 disposed therethrough. In the embodiment shown in FIG. 3B, the mounting apertures 70 are disposed adjacent to end portions 52A, 54A of the coupling tabs 52, 54, respectively. The mounting apertures 70 are configured to receive fasteners therethrough for coupling the coupling tabs 52, 54 to inner surfaces of spaced-apart sidewalls of a refrigerator liner, as further described below. As further shown in FIGS. 3A and 3B, the body portions 50 of the support brackets 34, 36 include outer surfaces 50A and inner surfaces 50B. With the support brackets 34, 36 coupled to opposite sides 38, 40 of the shelf panel 32, an overall first width W2 of the shelf assembly 30 is defined between the outer surfaces 50A of the support brackets 34, 36. In the configurations shown in FIGS. 3A, 3B, the first width W2 of the shelf assembly 30 is less than the width W1 of the refrigerator compartment 3 defined by the inner surfaces 12A, 14A of the refrigerator liner 10 shown in FIGS. 1 and 4. In this way, the shelf assembly 30 can be carefully installed within the refrigerator compartment 3 without the support brackets 34, 36 touching, scratching or otherwise marking the inner surfaces 12A, 14A of the refrigerator liner 10. The outer surfaces 50A of the support brackets 34, 36 also define outer surfaces of the coupling tabs 52, 54. As noted above, the coupling tabs 52, 54 are configured to flex outwardly with respect to the upright portions 64 of the support brackets 34, 36 from an at-rest position AR (shown in FIGS. 5C, 6A, 7A) to an outwardly flexed position OF (shown in FIGS. 6B and 7B). In the outwardly flexed position OF, the outer surfaces of the coupling tabs 52, 54 define a second width W3 (FIG. 7B) of the shelf assembly 30 that is greater than first width W1 of the shelf assembly 30 when the coupling tabs 52, 54 are in the at-rest position. In this way, the shelf assembly 30 is a variable width or adjustable shelf assembly as the coupling tabs 52, 54 flex outwardly relative to the upright portion 64 of the support brackets 34. 36.

Referring now to FIG. 4, the shelf assembly 30 is shown exploded away from the refrigerator compartment 3 of refrigerator 1. In FIG. 4, the exterior wrapper 20 (FIG. 1) has been removed such that an outer surface 12B of sidewall 12 is shown. In the embodiment shown in FIG. 4, a mounting plate 80 is shown coupled to the outer surface 12B of sidewall 12 of the refrigerator liner 10. Similarly, a second mounting plate 82 is shown coupled to an outer surface 14B of sidewall 14 of the refrigerator liner 10. Mounting features of the mounting plate 82 are shown extending through sidewall 14 and outwardly extending beyond the inner surface 14A of sidewall 14. These mounting features are further described below with particular references to FIGS. 5A and 5C and are used to couple the shelf assembly 30 to the refrigerator compartment 3 at support brackets 34, 36. The mounting plates 80, 82 are identical members mounted in a mirror configuration on the refrigerator 1 as shown in FIG. 4. Thus, like reference numerals will be used to describe the mounting plates 80, 82 with particular reference to FIGS. 5A-5C, and all features of one mounting plate specifically described are contemplated to be features of the companion mounting plate.

As further shown in the embodiment of FIG. 4, the mounting plates 80, 82 are coupled to the sidewalls 12, 14 of the refrigerator liner 10 at a location L2 which is disposed above a spacing S where one or more drawers may be located within the refrigerator compartment 3, such as drawers 18 shown in FIG. 1. It is contemplated that the refrigerator liner 10 is comprised of a polymeric material, such that the sidewalls 12, 14 are a polymeric material commonly used within the refrigerator industry. The support brackets 34, 36 are contemplated to be comprised of a metal material that may be coated or painted. Thus, in the installation of the shelf assembly 30, it is important that the support brackets 34, 36 do not contact the inner surfaces 12A, 14A of the refrigerator liner 10 as the shelf assembly 30 is inserted into the refrigerator liner in a substantially horizontal direction as indicated by arrow A. Once the shelf 30 is fully received horizontally within the refrigerator compartment 3, the shelf assembly 30 is moved downward in a direction as indicated by arrow B shown in FIG. 5C, such that the support brackets 34, 36 can locate to and engage with the mounting features of the mounting plates 80, 82. During movement of the shelf assembly 30 within the refrigerator compartment 3 in the directions as indicated by arrows A and B, it is important that the support brackets 34, 36 do not contact the inner surfaces 12A, 14A of the refrigerator liner 10. Thus, the first width W2 of the shelf assembly 30, as defined by the outer surfaces 50A of support brackets 34, 36, is less than the width W1 of the refrigerator compartment 3. In this way, the shelf assembly 30, and support brackets 34, 36 coupled thereto, can move within the refrigerator compartment 3 in the direction as indicated by arrows A and B without contacting the inner surfaces 12A, 14A of the refrigerator liner 10. The shelf assembly 30 is configured for a set-in-place engagement of the support brackets 34, 36 on the mounting features of the mounting plates 80, 82, as further described below, before a final coupling procedure is conducted to fixedly couple the shelf assembly 30 within the refrigerator compartment 3.

Figure 5A:
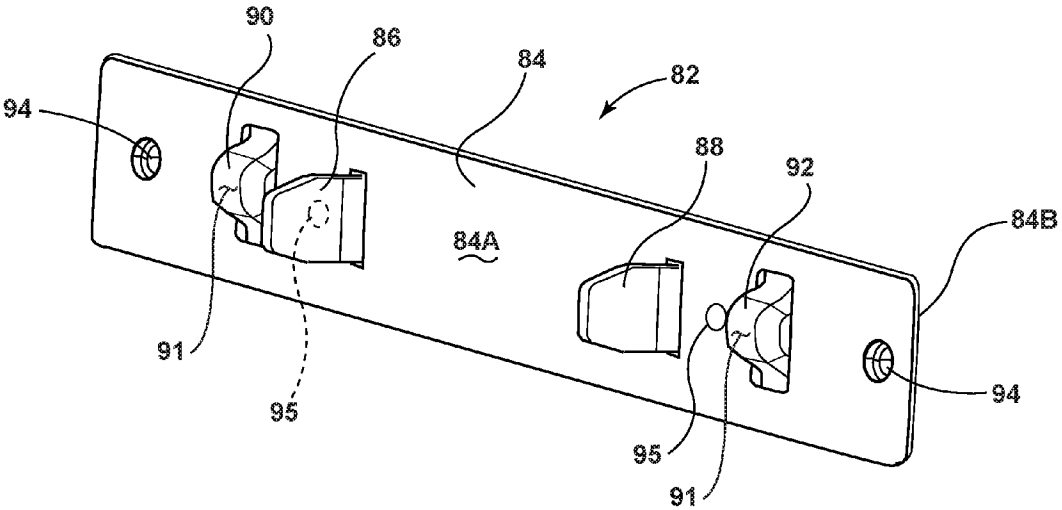
FIG. 5A is a front perspective view of a mounting plate.
Figure 5B:
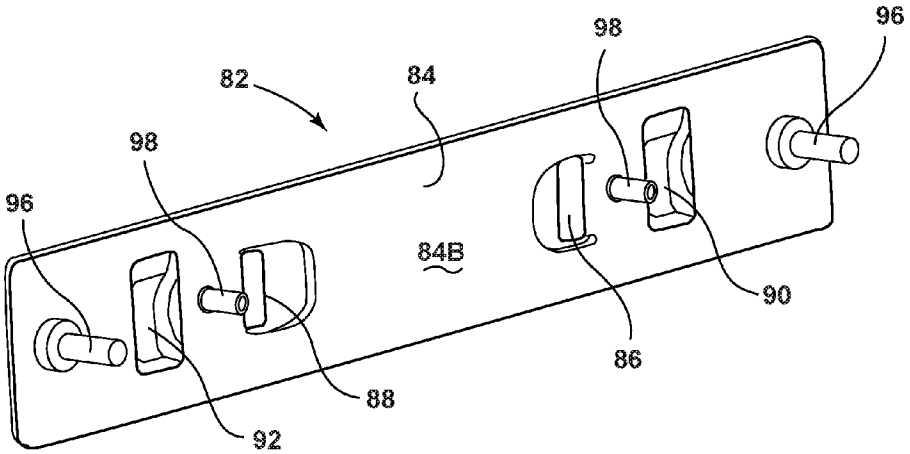
FIG. 5B is a rear perspective view of the mounting plate of FIG. 5A.

Referring now to FIG. 5A, mounting plate 82 is shown which, as described above, is identical to mounting plate 80 shown in FIG. 4. Thus, the same reference numerals will be used to describe the features of both mounting plates 80, 82. In FIG. 5A, mounting plate 82 includes a body portion 84 having an inner surface 84A and an outer surface 84B (FIG. 5B). The mounting plate 82 includes first and second mounting features 86, 88 extending outwardly from the inner surface 84A. The mounting features 86, 88 are shown in FIG. 5A as mounting fins or tabs that are configured to be received in the support slots 56, 58 of the support brackets 34, 36, respectively. Thus, the mounting features 86, 88 are configured to extend through the sidewalls 12, 14 of the refrigerator liner 10 and further extend beyond the inner surfaces 12A, 14A of the sidewalls 12, 14 in assembly. As further shown in FIG. 5A, abutment guides 90, 92 also extend outwardly from the inner surface 84A of the mounting plate 82 and, much like the mounting features 86, 88 are configured to extend through the sidewall to which the mounting plate 82 is coupled. The abutment guides 90, 92 are outwardly protruding structures having abutment surfaces 91 which are used to guide the direction of the coupling tabs 52, 54 as the coupling tabs 52, 54 outwardly flex during the final fixing procedure. As further shown in FIG. 5A, mounting apertures 94 are disposed on opposite sides of the mounting plate 82 and are configured to align with the mounting apertures 70 of the support brackets 34, 36 for receiving fasteners in assembly.

Referring now to FIG. 5B, mounting plate 82 is shown from a rear perspective view, wherein mounting bosses 96 are shown extending outwardly from the outer surface 84B of the body portion 84 of the mounting plate 82. With reference to FIG. 5A, the mounting apertures 94 open into the mounting bosses 96 shown in FIG. 5B. The mounting bosses 96 are configured to receive a fastener that couples the support brackets 34, 36 of the shelf assembly 30 to the mounting plate 80, 82 in assembly. As further shown in FIG. 5B, locating bosses 98 are shown extending outwardly from the outer surface 84B of the body portion 84 of mounting plate 82. With reference to FIG. 5A, access apertures 95 open into the locating bosses 98, and the locating bosses 98 are configured to receive a fastener to retain the mounting plates 80, 82 on an outer surface of a sidewall of the refrigerator liner 10 as further described below. Thus, the mounting plate 82 shown in FIGS. 5A and 5B includes a generally planar body portion having an inner surface 84A that is configured to abut an outer surface of a sidewall of a refrigerator liner, such as outer surfaces 12B, 14B of sidewalls 12, 14 of refrigerator liner 10 described above.

Figure 5C:
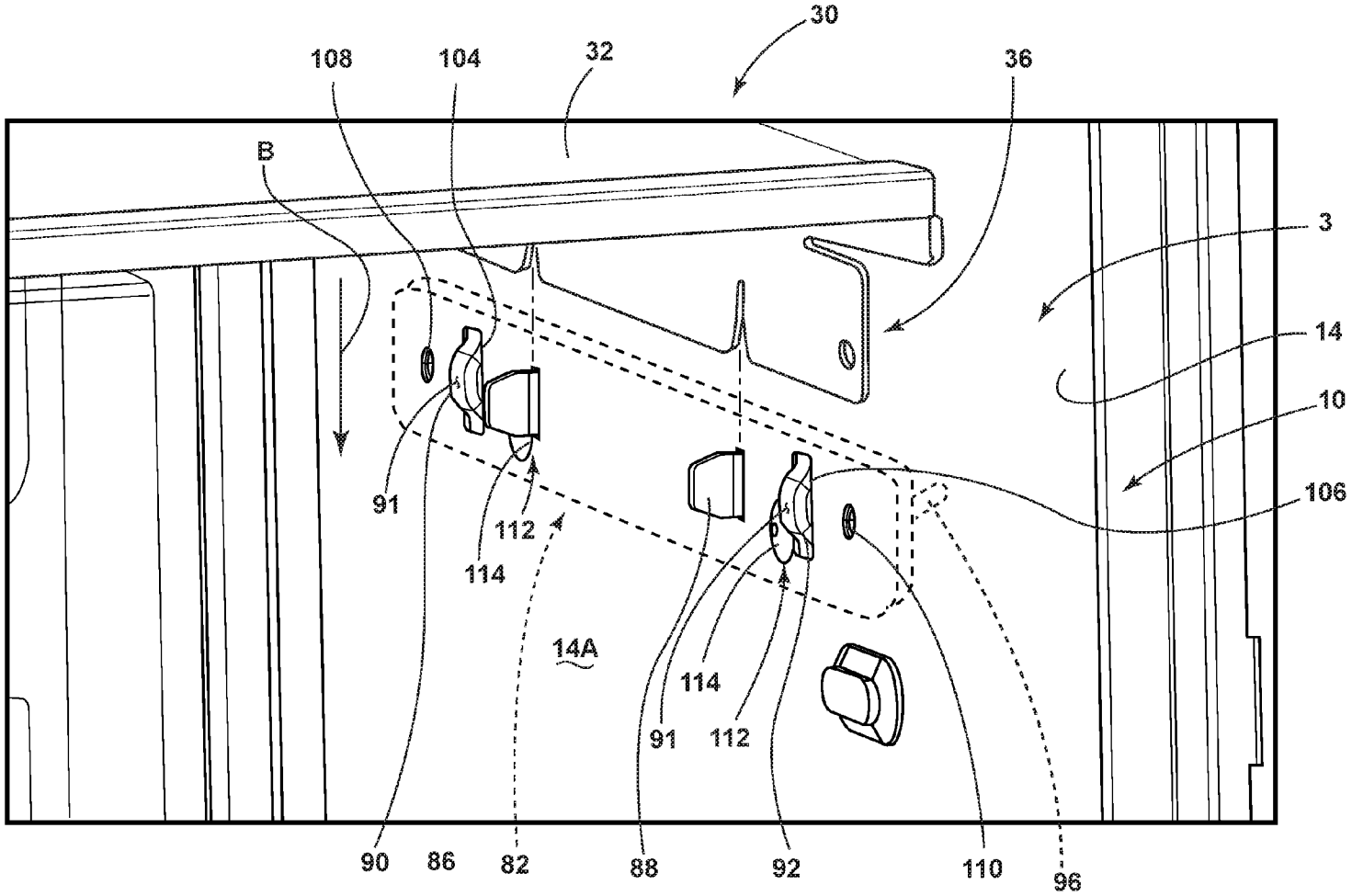
FIG. 5C is a front perspective view of the mounting plate of FIG. 5A installed on a sidewall of a refrigerator liner.

Referring now to FIG. 5C, the shelf assembly 30 is shown positioned above the mounting plate 82 which is coupled to sidewall 14 of the refrigerator liner 10. The shelf assembly 30 is configured for set-in-place support from an engagement between the support bracket 36 and mounting plate 82 when the shelf assembly 30 is moved downward in a direction as indicated by arrow B. As further shown in FIG. 5C, the sidewall 14 of the refrigerator liner 10 includes inner slots 100, 102 and outer slots 104, 106. The mounting features 86, 88 of the mounting plate 82 are configured to be received through the inner slots 100, 102 of the sidewall 14, such that the mounting features 86, 88 extend inwardly into the refrigerator compartment 3 beyond inner surface 14A of sidewall 14. Similarly, the abutment guides 90, 92 extend inwardly into the refrigerator compartment 3 through outer slots 104, 106, respectively. In this way, the mounting features 86, 88 and the abutment guides 90, 92 are exposed within the refrigerator compartment 3 and are accessible for engagement with the support brackets 34, 36 of the shelf assembly 30 by extending through slots of the plurality of slots disposed on the sidewalls 12, 14.

As further shown in FIG. 5C, the sidewall 14 further includes mounting apertures 108, 110 which are configured to align with the mounting apertures 70 of the support brackets 34, 36, as well as mounting apertures 94 of mounting plates 80, 82 in assembly. When the mounting plate 82 is positioned on an outer surface 14B of sidewall 14 by aligning the mounting features 86, 88 and abutment guides 90, 92 with the inner slots 100, 102 and outer slots 104, 106, respectively, the mounting plate 82 is retained in this position using fasteners 112, which include head portions 114. In assembly, the fasteners 112 extend through access apertures disposed through the sidewall 14 and align with locating apertures 95 (FIG. 5A) of the mounting plate 82. The fasteners 112 are contemplated to have shaft portions which engage the locating bosses 98 extending outwardly from the outer surface 84B of mounting plate 82. In this way, the mounting plates 80, 82 can be positioned on the outer surfaces 12B, 14B of the refrigerator liner 10 and retained on these outer surfaces 12B, 14B using fasteners 112 as received in locating bosses 98 of the mounting plates 80, 82. With the mounting plates 80, 82 retained in place on the sidewalls 12, 14, the shelf assembly 30 can move downward in the direction as indicated by arrow B for engagement with the mounting features 86, 88 of the mounting plate 82 at support slots 56, 58 of the support brackets 34, 36.

Figure 6A:
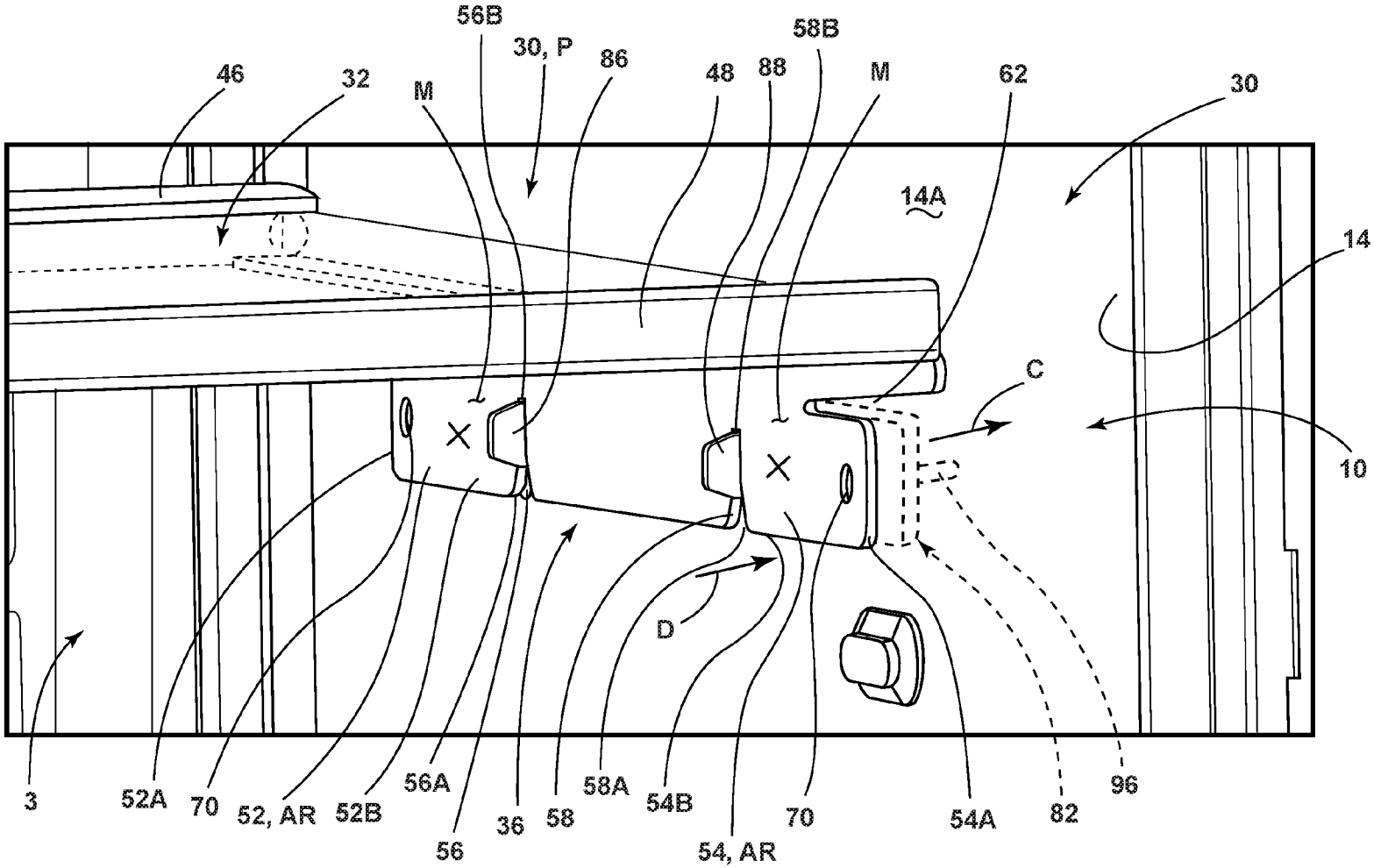
FIG. 6A is a top perspective view of the shelf assembly of FIG. 3A supported on the sidewall and mounting plate of FIG. 5C in a set-in-place position.

Referring now to FIG. 6A, the shelf assembly 30 has been moved downward in a direction as indicated by arrow B for a set-in-place engagement with mounting plate 82. With the shelf assembly 30 in the set-in-place position P, the mounting features 86, 88 of the mounting plate 82 extending through sidewall 14 have been received in the support slots 56, 58 of support bracket 36 for supporting the shelf assembly 30 within in the refrigerator compartment 3. As noted above, the support slots 56, 58 are tapered, such that the mounting features 86, 88 are closely received at the closed top ends 56B, 58B of the support slots 56, 58 after passing through the open bottom ends 56A, 58A. The mounting apertures 70 of the support bracket 36 are configured to receive fasteners and are aligned with the mounting apertures 110 of sidewall 14, as well as mounting apertures 94 of mounting plate 82. As further shown in FIG. 6A, the mounting aperture 70 of support bracket 36 also align with the mounting bosses 96 of mounting plate 82. The mounting apertures 70 are disposed adjacent the end portions 52A, 54A of coupling tabs 52, 54. In this way, when a fastener is received in the mounting apertures 70 and engaged with mounting bosses 96, the coupling tabs 52, 54 can bend approximately at the locations X indicated in FIG. 6 which are also the locations where the outer surface 50A (FIG. 3) of the support bracket 36 will abut outer abutment surfaces 91 of the abutment guides 90, 92 of the mounting plate 82 as they extend through the sidewall 14 of the refrigerator liner 10 (FIG. 5A). The ability of the coupling tabs 52, 54 to bend in the directions as indicated by arrows C and D is due to the location of the support slots 56, 58 in conjunction with the relief slots 60, 62 of the support bracket 36. These cutout portions provided by support slots 56, 58 and relief slots 60, 62 provide for a band of material M disposed therebetween which can bend under the force of a fastener being received in mounting boss 96. In this way, the coupling tabs 52, 54, and particularly the end portions 52A, 54A of coupling tabs 52, 54, will bend from the at-rest positions AR of the coupling tabs 52, 54 shown in FIG. 6A to an outwardly flexed position OF (FIG. 6B) to abut the inner surfaces 12A, 14A of the sidewalls 12, 14 of the refrigerator liner 10. The bending motion of the coupling tabs 52, 54 is guided by the abutment guides 90, 92 and their engagement with outer surface 50A of the support brackets 34, 36. When the support brackets 34, 36 are in the set-in-place position on the mounting features 86, 88 of the mounting plates 80, 82 (see FIG. 6A), the abutment guides 90, 92 (see FIG. 5A) are properly aligned with the support brackets 34, 36 to bend the coupling tabs 52, 54 at a predictable location X. In this way, the front end portion 54A will have a tight fit against the sidewall 14 of the refrigerator liner 10 as shown in FIG. 7B.

Figure 6B:
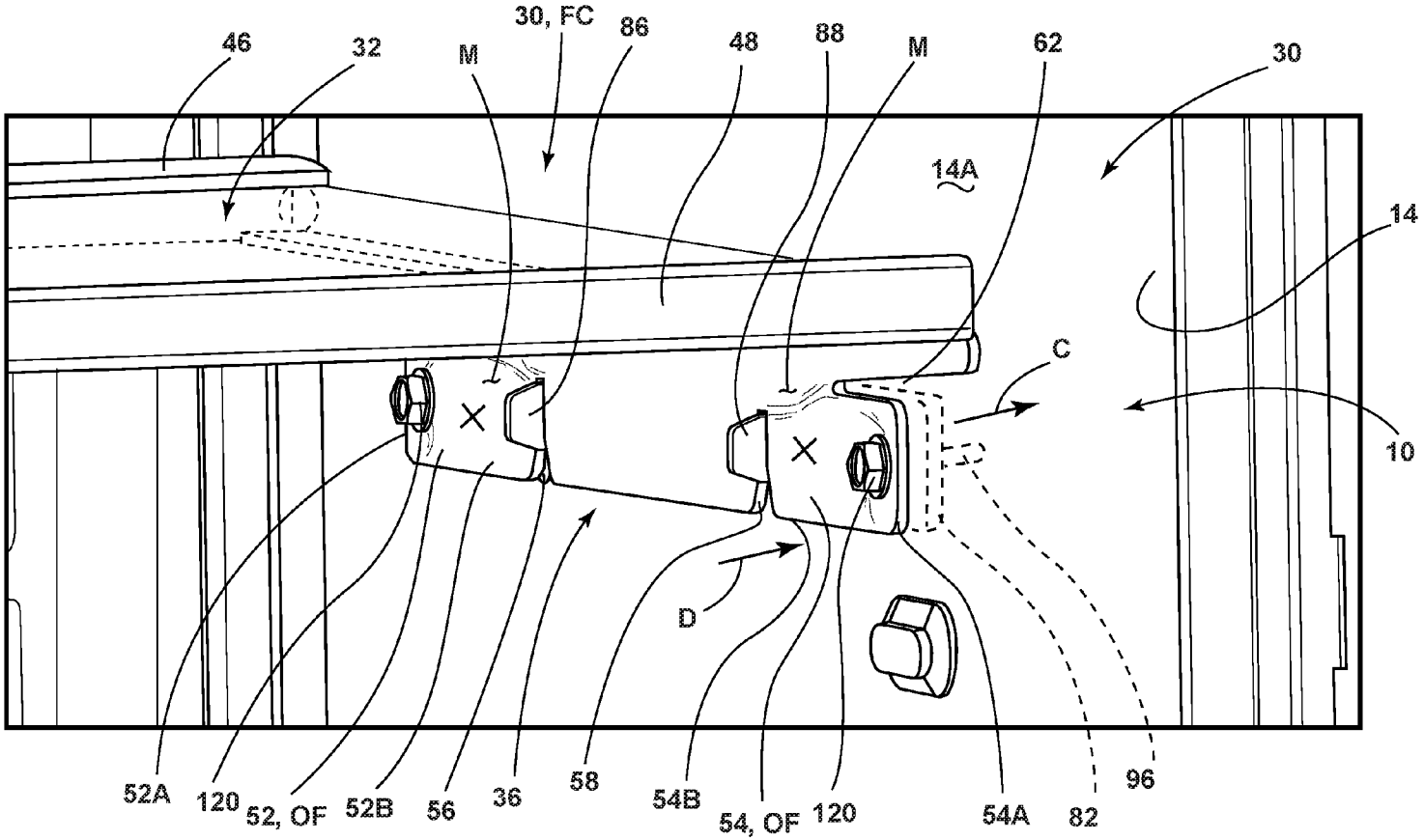
FIG. 6B is a top perspective view of the shelf assembly of FIG. 6A fixedly coupled to the liner sidewall.

Referring now to FIG. 6B, fasteners 120 have been received in mounting apertures 70 of support bracket 36. As noted above, the fasteners 120 engage the mounting bosses 96 of mounting plate 82 for fixedly coupling the shelf assembly 30 to the sidewalls 12, 14 of the refrigerator compartment 3. With the shelf assembly 30 in the fixedly coupled position FC, the fasteners 120 have driven the coupling tabs 52, 54 from the at-rest position AR (FIG. 6A) to an outwardly flexed or coupled position OF shown in FIG. 6B to sandwich the liner sidewall 14 between the support bracket 36 and the mounting plate 82. In the outwardly flexed position OF, the coupling tabs 52, 54 are snug fit against the inner surface 14A of sidewall 14 having bent or flexed outwardly at location X. By Flexing outwardly, the coupling tabs 52, 54 have defined a second width W3 (FIG. 7B) of the shelf assembly 30 that is greater than first width W2 defined with the coupling tabs 52, 54 in the at-rest position AR (FIG. 6A).

Figure 7A:
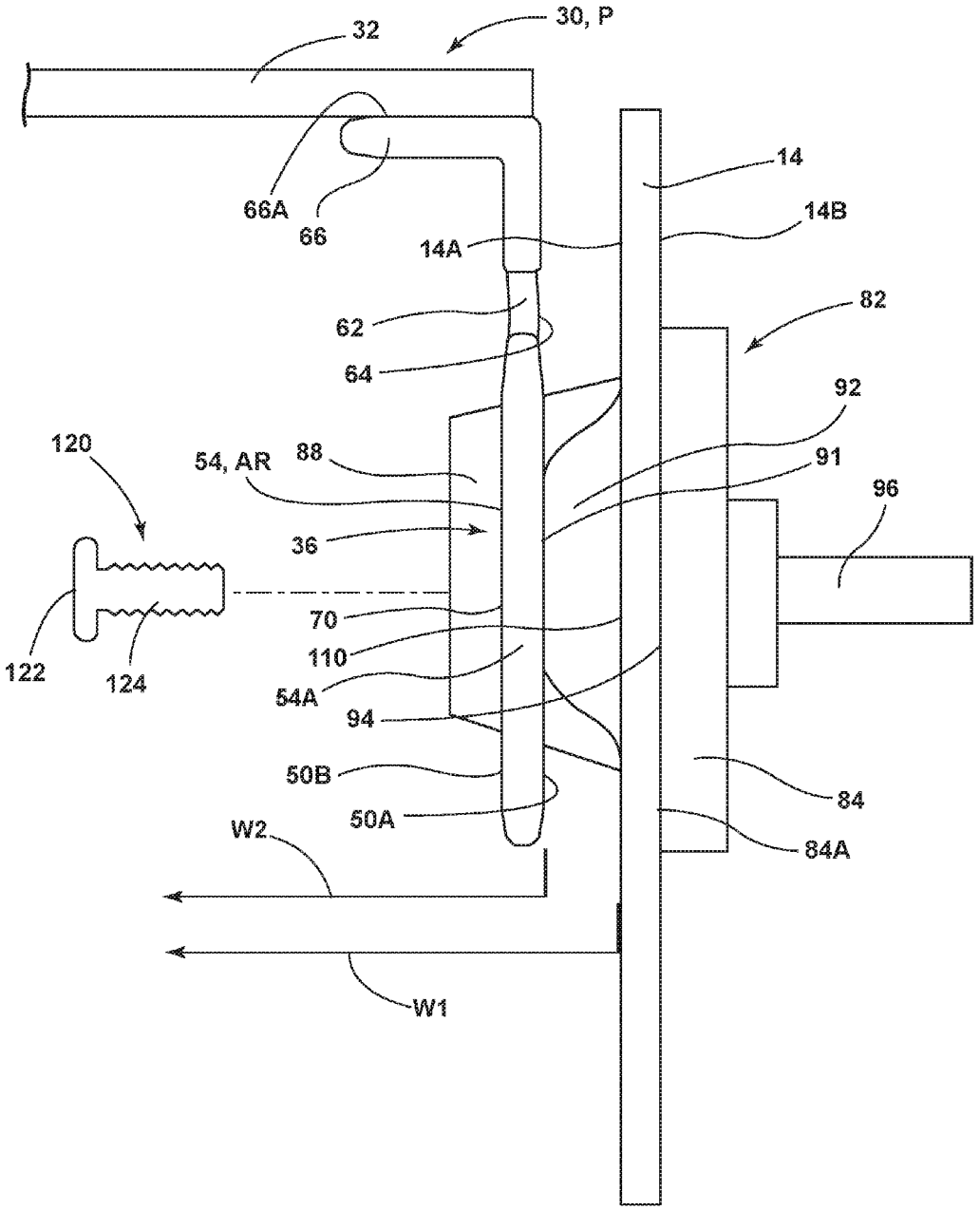
FIG. 7A is a side elevational view of the support bracket of FIG. 6A in a set-in-place position.

Referring now to FIG. 7A, the shelf assembly 30 is shown in the set-in-place position P, with coupling tab 54 of the support bracket 36 in the at-rest position AR. In the at-rest position AR, coupling tab 54 defines a first width W2 of the shelf assembly 30 at outer surface 50A thereof. Mounting feature 88 of mounting plate 82 is disposed within supporting slot 58 in FIG. 7A, and this arrangement is best shown in FIG. 6A. The inner surface 84A of mounting plate 82 is shown abutting the outer surface 14B of sidewall 14 as positioned thereon, and abutment surface 91 of abutment guide 92 is shown abutting the outer surface 50A of the coupling tab 54. A fastener 120 is shown ready to be received through mounting apertures 70, 110 and 94 of the support bracket 36, liner sidewall 14, and mounting plate 82, respectively. The fastener 120 includes a head portion 122 and a shaft portion 124. In assembly, the head portion 122 abuts the inner surface 50B of the support bracket 36 while shaft portion 124 extends through the aligned mounting apertures 70, 110 and 94 for engagement with mounting boss 96. It is contemplated that shaft portion 124 is a threaded member that is threadingly engaged with a threaded channel of mounting boss 96 in assembly.

Figure 7B:
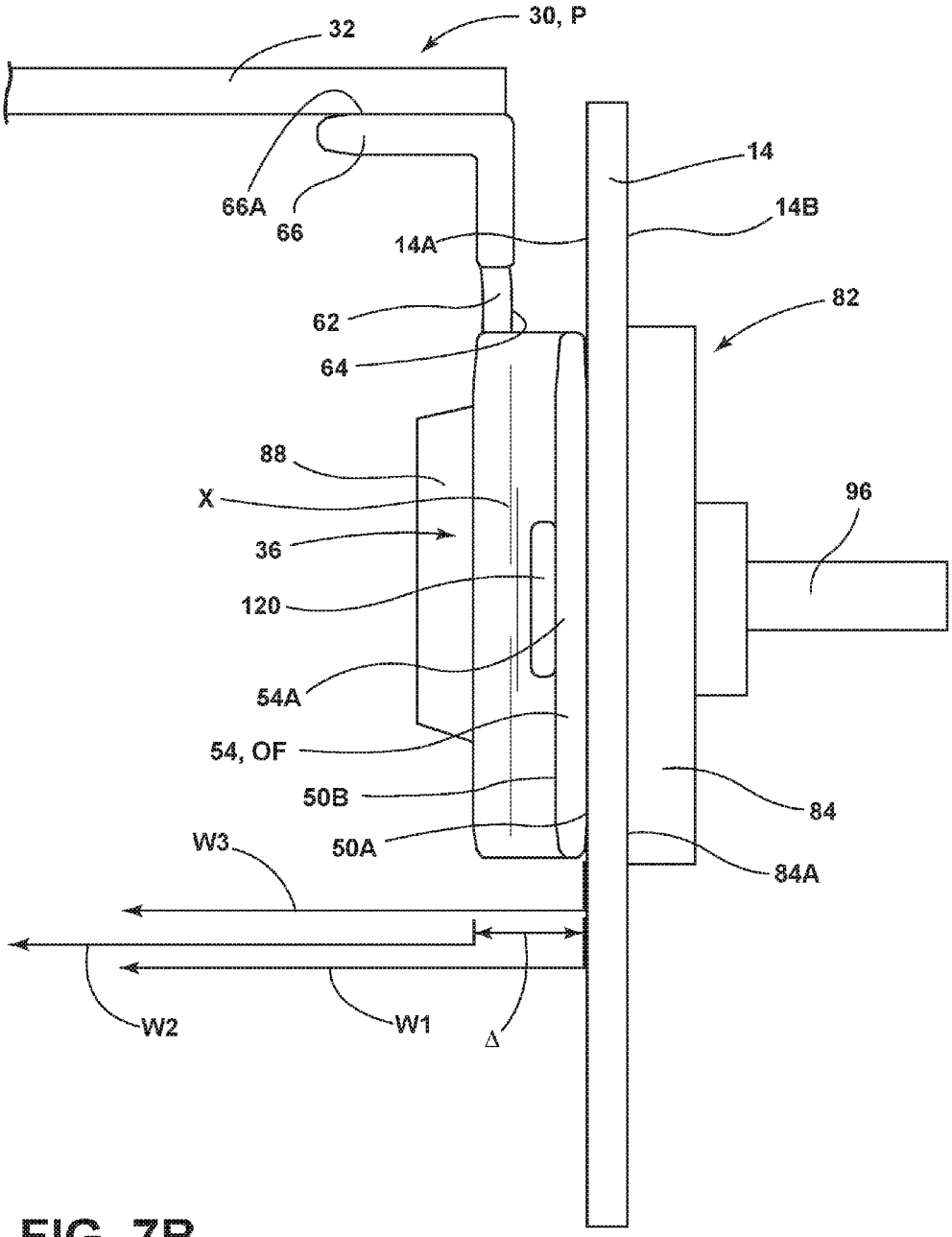
FIG. 7B is a side elevational view of the support plate of FIG. 7A as fixedly coupled to the mounting plate.

Referring now to FIG. 7B, support bracket 36 is shown in the fixedly coupled position FC, wherein coupling tab 54 has been driven by fastener 120 from the at-rest position AR (FIG. 7A) to the outwardly flexed or coupled position OF. As driven by fastener 120 from the at-rest position AR to the outwardly flexed position OF, the coupling tab 54 has bent or flexed outwardly, such that outer surface 50A of the support bracket 36 abuts the inner surface 14A of the liner sidewall 14. As noted above, this bending motion of the coupling tab 54 is guided by abutment guide 92 to ensure that the coupling tab 54 bends in a predictable manner at a predictable location X shown in the FIGS. 6A and 6B. As bent outwardly, coupling tab 54 has moved outward to define a second width W3 of the shelf assembly 30 that is greater than the first width W2 shown in FIG. 7A. Width W3 brings the shelf assembly 30 to a position spanning the full width W1 of the refrigerator compartment. In this way, the shelf assembly 30 is a variable width shelf assembly having a first width W2 that allows for the shelf assembly to be positioned in the set-in-place position P (FIGS. 6A, 7A) without contacting the liner sidewalls 12, 14, while also being adjustable to a second width W3 that is greater than first width W2. At second width W3, the support bracket 34, 36 are closely coupled with the liner sidewalls 12, 14 and mounting plates 80, 82. The difference in widths Δ between first width W2 and second width W3 is shown in FIG. 7B and contemplated to be equivalent to a few millimeters on each side of the shelf assembly 30 at the location of the opposed support brackets 36, 38.

Figure 8:
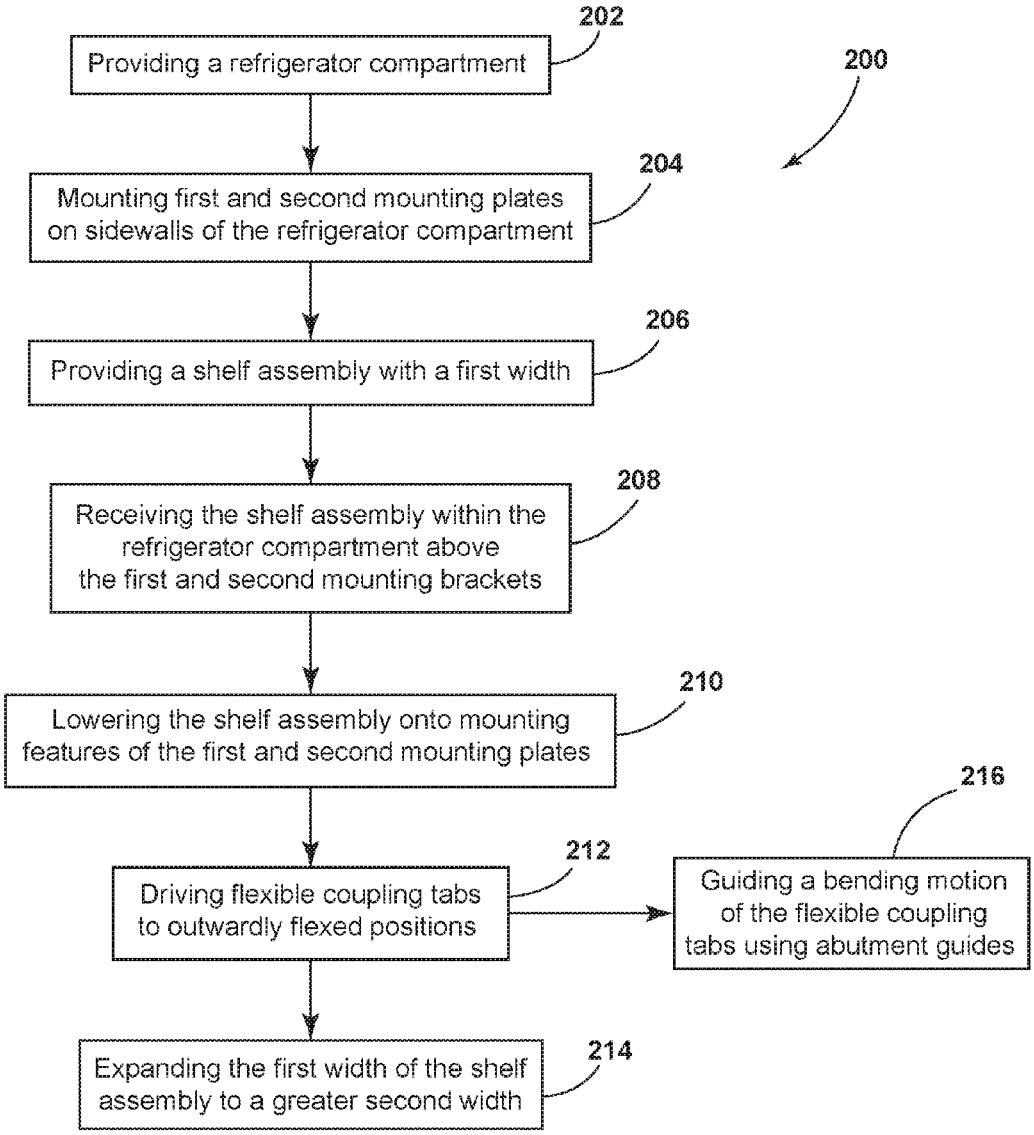
FIG. 8 is a flow chart representing a method of installing an adjustable shelf assembly in a refrigerator.

Referring now to FIG. 8, a method 200 of installing the shelf assembly 30 is outlined. The method 200 includes the following procedural steps: Step 202) providing a refrigerator compartment 3 (FIG. 1) having a width W1 defined between inner surfaces 12A, 14A of opposed first and second sidewalls 12, 14 of the refrigerator compartment 3; Step 204) mounting first and second mounting plates 80, 82 (FIG. 4) on each of the sidewalls 12, 14 of the refrigerator compartment 3, wherein the first and second mounting plates 80, 82 include one or more mounting features 86, 88 (FIG. 5A) extending into the refrigerator compartment 3 through the first and second sidewalls 12, 14, respectively; Step 206) providing a shelf assembly 30 (FIG. 3A) having first and second support brackets 34, 36 disposed on opposite sides 38, 40 thereof, the first and second support brackets 34, 36 including outer surfaces 50A, one or more flexible coupling tabs 52, 54 and one or more support slots 56, 58, wherein the outer surfaces 50A of the support brackets 34, 36 define a first width W2 of the shelf assembly 30, and further wherein the first width W2 of the shelf assembly 30 is less than the width W1 of the refrigerator compartment 3 (FIG. 7A); Step 208) receiving the shelf assembly 30 (FIG. 5C) within the refrigerator compartment 3 above the first and second mounting brackets 80, 82; Step 210) lowering the shelf assembly 30 to a set-in-place position P (FIGS. 6A, 7A) such that the one or more mounting features 86, 88 of the first and second mounting plates 80, 82 are received in the one or more support slots 56, 58 of the first and second support brackets 34, 36, respectively; Step 212) driving the one or more flexible coupling tabs 52, 54 from at-rest positions AR (FIG. 7A) to outwardly flexed positions OF (FIG. 7B) using one or more fasteners 120; and Step 214) expanding the first width W2 of the shelf assembly 30 to a second width W3 (FIG. 7B) defined by outer surfaces 50A of the one or more flexible coupling tabs 52, 54 when the one or more flexible coupling tabs 52, 54 are in the outwardly flexed positions OF.

The method 200 outlined in FIG. 8 further includes Step 216) guiding a bending motion of the one or more flexible coupling tabs 52, 54 using one or more abutment guides 90, 92 disposed on the first and second mounting plates 80, 82 and extending into the refrigerator compartment 3 through the first and second sidewalls 12, 14 of the refrigerator compartment 3.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A variable width shelf assembly, comprising:

a shelf panel;

first and second support brackets coupled to the shelf panel at opposite sides thereof, each support bracket including:

a body portion having an upright portion and a support portion extending inwardly from the upright portion;

one or more support slots disposed on the upright portion;

one or more relief slots disposed on the upright portion; and one or more coupling tabs disposed adjacent to one of the one or more support slots and one of the one or more relief slots, wherein the one or more coupling tabs are flexible tabs configured to flex outwardly relative to the upright portion of the body portion for coupling the first and second brackets to a refrigerator compartment, and further wherein the one or more coupling tabs include mounting apertures disposed therethrough near end portions of the one or more coupling tabs.

2. The variable width shelf assembly of claim 1, wherein the one or more support slots disposed on the upright portion extend upwardly from a bottom edge of the body portion.

3. The variable width shelf assembly of claim 2, wherein the one or more support slots tapper from an open bottom end thereof to a closed top end thereof.

4. The variable width shelf assembly of claim 3, wherein the one or more relief slots disposed on the upright portion extend inwardly from opposed ends of the body portion in a substantially horizontal direction.

5. The variable width shelf assembly of claim 4, wherein the one or more relief slots tapper from an open outer end thereof to a closed inner end thereof.

6. The variable width shelf assembly of claim 1, wherein the first and second support brackets include outer surfaces defining a first overall width of width for the shelf assembly as coupled to the shelf panel.

7. The variable width shelf assembly of claim 6, wherein the one or more coupling tabs flex outwardly in a coupled position to define a second overall width of the shelf assembly, wherein the second width of the shelf assembly is greater than the first width of the shelf assembly.

8. An adjustable shelf assembly for a refrigerator, comprising:

first and second opposed sidewalls having inner and outer surfaces and defining a refrigerator compartment, wherein the refrigerator compartment includes a width defined between the inner surfaces of the first and second sidewalls, and further wherein the first and second sidewalls include a plurality of slots disposed therethrough;

first and second mounting plates coupled to the outer surfaces of the first and second sidewalls, respectively, each of the first and second mounting plates including one or more mounting features received through one or more slots of the plurality of slots disposed through the first and second sidewalls; and a shelf assembly having a shelf panel with first and second support brackets disposed on opposed side edges of the shelf panel, the first and second support brackets each including a body portion having an upright portion with one or more coupling tabs disposed thereon, the coupling tabs configured to flex outwardly relative to the upright portion of the body portion for coupling the first and second brackets to the first and second mounting plates, respectively, wherein the body portion further includes one or more support slots, wherein the one or more mounting features of the mounting plates are received in the one or more support slots within the refrigerator compartment.

9. The adjustable shelf assembly of claim 8, wherein the shelf assembly includes a first width defined between outer surfaces of the first and second support brackets, and further wherein the first width of the shelf assembly is less than the width of the refrigerator compartment.

10. The adjustable shelf assembly of claim 9, wherein the one or more coupling tabs are operable between at-rest and outwardly flexed positions.

11. The adjustable shelf assembly of claim 10, wherein the shelf assembly includes a second width defined between outer surfaces of the one or more coupling tabs when the coupling tabs are in the flexed position.

12. The adjustable shelf assembly of claim 11, wherein the second width of the shelf assembly is greater than the first width of the shelf assembly.

13. The adjustable shelf assembly of claim 10, including:

one or more mounting apertures disposed on the first and second mounting plates; and one or more mounting apertures disposed on the first and second support brackets, wherein the one or more mounting apertures disposed on the first and second support brackets are configured to align with the one or more mounting apertures disposed on the first and second mounting plates, respectively.

14. The adjustable shelf assembly of claim 13, wherein the one or more mounting apertures disposed on the first and second support brackets are disposed on the one or more coupling tabs, and further wherein one or more fasteners are received through the one or more mounting apertures of the first and second support brackets and the one or more mounting apertures of the first and second mounting plates, the one or more fasteners configured to drive the coupling tabs to the outwardly flexed position from the at-rest position.

15. The adjustable shelf assembly of claim 14, including:

one or more abutment guides extending outwardly from inner surfaces of the first and second mounting plates and received through one or more slots of the plurality of slots disposed through the first and second sidewalls.

16. The adjustable shelf assembly of claim 15, wherein the one or more abutment guides include outer abutment surfaces abutting the outer surfaces of the first and second support brackets.

17. The adjustable shelf assembly of claim 15, wherein the one or more abutment guides direct a bending motion of the one or more coupling tabs from the at-rest position to the flexed position.

18. A method of installing a shelf assembly in a refrigerator, the method comprising the steps of:

providing a refrigerator compartment having a width defined between inner surfaces of opposed first and second sidewalls of the refrigerator compartment;

mounting first and second mounting plates on each of the sidewalls of the refrigerator compartment, wherein the first and second mounting plates include one or more mounting features extending into the refrigerator compartment through the first and second sidewalls, respectively;

providing a shelf assembly having first and second support brackets disposed on opposite sides thereof, the first and second support brackets including outer surfaces, one or more flexible coupling tabs and one or more support slots, wherein the outer surfaces of the support brackets define a first width of the shelf assembly, wherein the first width of the shelf assembly is less than the width of the refrigerator compartment;

receiving the shelf assembly within the refrigerator compartment above the first and second mounting brackets;

lowering the shelf assembly such that the one or more mounting features of the first and second mounting plates are received in the one or more support slots of the first and second support brackets, respectively;

driving the one or more flexible coupling tabs from at-rest positions to outwardly flexed positions using one or more fasteners; and expanding the first width of the shelf assembly to a second width defined by outer surfaces of the one or more flexible coupling tabs when the one or more flexible coupling tabs are in the outwardly flexed positions.

19. The method of claim 18, wherein the step of driving the one or more flexible coupling tabs from at-rest positions to outwardly flexed positions using one or more fasteners further includes:

guiding a bending motion of the one or more flexible coupling tabs using one or more abutment guides disposed on the first and second mounting plates and extending into the refrigerator compartment through the first and second sidewalls of the refrigerator compartment.

* * * * *